United States Patent [19]

Saunders

[11] Patent Number: 4,633,362

[45] Date of Patent: Dec. 30, 1986

[54] SOLENOID DRIVEN METERING PUMP SUPPLY VOLTAGE COMPENSATION CIRCUIT

[75] Inventor: David N. Saunders, North Berwick, Me.

[73] Assignee: Pennwalt Corporation, Philadelphia, Pa.

[21] Appl. No.: 806,583

[22] Filed: Dec. 9, 1985

[51] Int. Cl.[4] ..... H01H 47/32

[52] U.S. Cl. ..... 361/152; 361/170

[58] Field of Search ..... 361/152, 154, 170, 187

[56] References Cited

U.S. PATENT DOCUMENTS 4,019,100 4/1977 Barrus ..... 361/187 X

*Primary Examiner*—Michael L. Gellner

[57] ABSTRACT

Circuitry is provided for use with solenoid driven apparatus, such as a metering pump, for example, which is typically powered by direct current from a full wave rectifier. The circuit compensates for variations in the supply voltage by adjusting solenoid "on-time" in substantially inverse relationship to the supply voltage by powering an RC charging network of an integrated circuit directly from the secondary of a transformer supplying power to the solenoid.

12 Claims, 7 Drawing Figures

SOLENOID CURRENT OVER A SINGLE PULSE

SOLENOID CURRENT OVER A SINGLE PULSE WITH VARYING SUPPLY VOLTAGE

SOLENOID CURRENT OVER A SINGLE PULSE WITH VARYING SUPPLY VOLTAGE AND WITH ON-TIME COMPENSATION

SOLENOID WITH SUPPLY VOLTAGE COMPENSATION

SOLENOID DRIVEN METERING PUMP SUPPLY VOLTAGE COMPENSATION CIRCUIT

STATEMENT OF THE INVENTION

The present invention relates to electronic circuitry which compensates for variations in the supply line powering a solenoid which drives a metering pump such that its piston operates at substantially constant maximum force.

BACKGROUND AND SUMMARY OF THE INVENTION

In a pump of the type employed herein, a solenoid armature reciprocates to displace a diaphragm a distance commensurate with the length of the armature stroke. Since the diaphragm is disposed between suction and discharge ball valves, compression and relaxation of the diaphragm serves to pump process fluid therethrough.

A suitable metering pump which may be controlled by the supply voltage compensation circuit of the present invention is the 45 Series Chempulse® Electronic Pump of Wallace & Tiernan, Belleville, N.J.

The advent of inexpensive electronic power switching devices has fostered the popularity of solenoid driven metering pumps which are capable of delivering accurate and predetermined amounts of fluid. Such pumps readily lend themselves to proportioning applications where an external signal is sometimes used to trigger a solenoid stroke in direct proportion to another fluid flow for precise dosing.

Precise dosage or metering is characteristic of a metering pump which operates by moving a diaphragm in and out of the cavity by energizing and de-energizing an electromagnetic oil-filled solenoid in distinct pulses. Such a metering pump will typically pulse four to one hundred times per minute.

The force with which the diaphragm is pushed into the pump cavity varies over a single pulse from zero to some maximum value, and is a function of electrical current in the solenoid. The maximum piston force directly sets the maximum pumping pressure for the pump. This maximum pumping pressure is ideally maintained at a constant value, selected for a particular pump's construction and application. The maximum solenoid current, and hence the maximum pumping pressure, varies as the voltage applied across the solenoid windings varies with line voltage. These line voltage variations are normal.

In present designs, the presence of these voltage variations requires the power applied to the solenoid be sufficient to deliver the metered amount of fluid against rated back pressure at the lowest of operating line or supply voltages. At higher voltages, the energy and hence force delivered by the solenoid increases substantially. This energy increase however does not improve pump performance, but (a) causes the pump to run hotter resulting in the possible need for associated ventilating equipment, and (b) unnecessarily raises the solenoid driving force which increases the pump's output pressure to higher than normal operating pressures. Particularly in those applications where the pump's discharge piping path may have been terminated by the inadvertent closing of a valve, pressures may reach the burst pressure of the pipe with concomitant harm and/or danger to associated equipment and nearby personnel.

The present invention provides means for compensating the solenoid current, and hence, resulting pump pressure, for changes in supply voltage, i.e., to maintain substantially constant maximum pump pressure as supply voltage varies over its normal range.

DETAILED DESCRIPTION OF THE INVENTION

Figure 1:
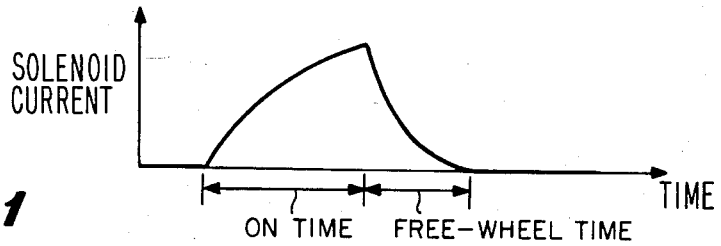
FIG. 1 is a graphical representation illustrating solenoid current over a single pulse.
Figure 2:
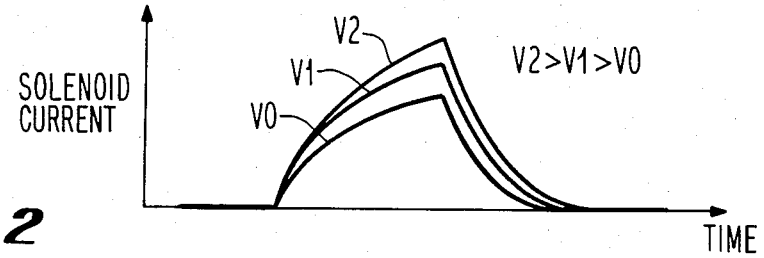
FIG. 2 graphically represents solenoid current over a single pulse with a varying supply voltage.
Figure 3:
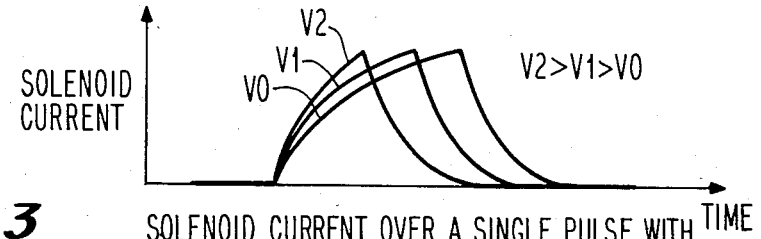
FIG. 3 is a graphical representation illustrating solenoid current over a single pulse with varying supply voltages and with On-time compensation as provided for by the present invention.

In order to better understand the supply voltage compensation circuit of the present invention, reference is made to FIGS. 1, 2 and 3 of the drawings.

In FIG. 1, during the time period shown as "on-time", a voltage is applied across the solenoid terminals. The current rises in an exponential function from zero to a maximum value. This current function is the result of applying a nearly constant voltage across a resistive and inductive solenoid. At the termination of the on-time, the voltage drive to the solenoid is removed causing the voltage across the solenoid to reverse, resulting in the current decaying exponentially to zero. This is the so-called "free-wheel" time indicated in FIG. 1. For a typical application, on-time and free-wheel time are each on the order of 50 to 250 ms. The voltage applied during on-time may be derived from the ac line by a full-wave rectifier circuit.

Now consider the solenoid current function over a single pulse as the supply voltage varies, shown by the family of curves in FIG. 2. On-time is held constant but peak solenoid current varies with the supply voltage.

In FIG. 3, supply voltage varies and on-time is varied. The on-time is made shorter for high supply voltage, and longer for low supply voltage. It is noted that the peak solenoid current however is maintained nearly constant as the supply voltage varies.

Figure 4:
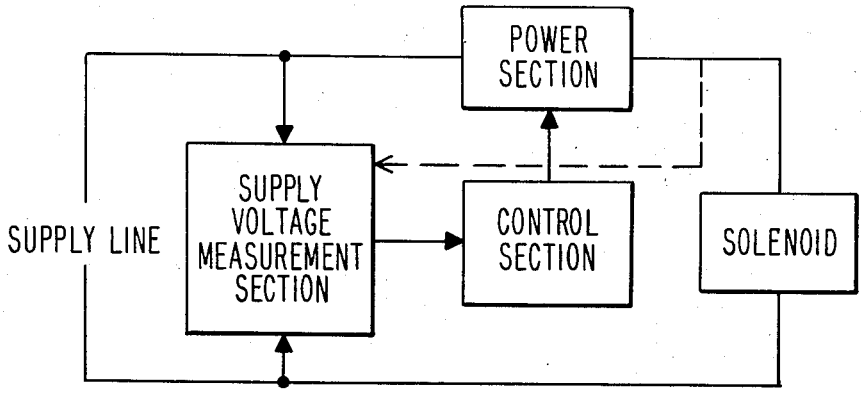
FIG. 4 is a block diagram illustrating the present supply voltage compensation system for use with a solenoid driven metering pump.

The supply voltage compensation system of the present invention comprises a power section, a control section, and a supply voltage measurement section, as shown in FIG. 4. Briefly, the power section includes circuit elements arranged to apply a voltage across the solenoid terminals during on-time, and to allow the solenoid voltage to reverse during the free-wheel time, in order that the solenoid current may follow the general shape illustrated in FIG. 1.

The control section commands the power section to pulse the solenoid according to control settings for pulse repetition rate, baseline on-time, free-wheel time, and according to supply voltage information obtained from the circuit of the supply voltage measurement section.

The power section applies a voltage derived from supply through any combination of semiconductor devices including diodes, transistors, and solid state relays; passive components including resistors, capacitors and inductors; and electromechanical components including relays.

The supply voltage measuring circuit measures the supply voltage directly from the ac or dc supply lines, passive device network, opto-electronic device, thermal device, or from a rectified line voltage or transformer when the supply is from an ac line. The signal from the supply voltage measuring circuit to the control section may be voltage, current, frequency, digital data, phase angle, temperature, resistance or impedance, or other physical parameter detectable by the control section.

Figure 5:
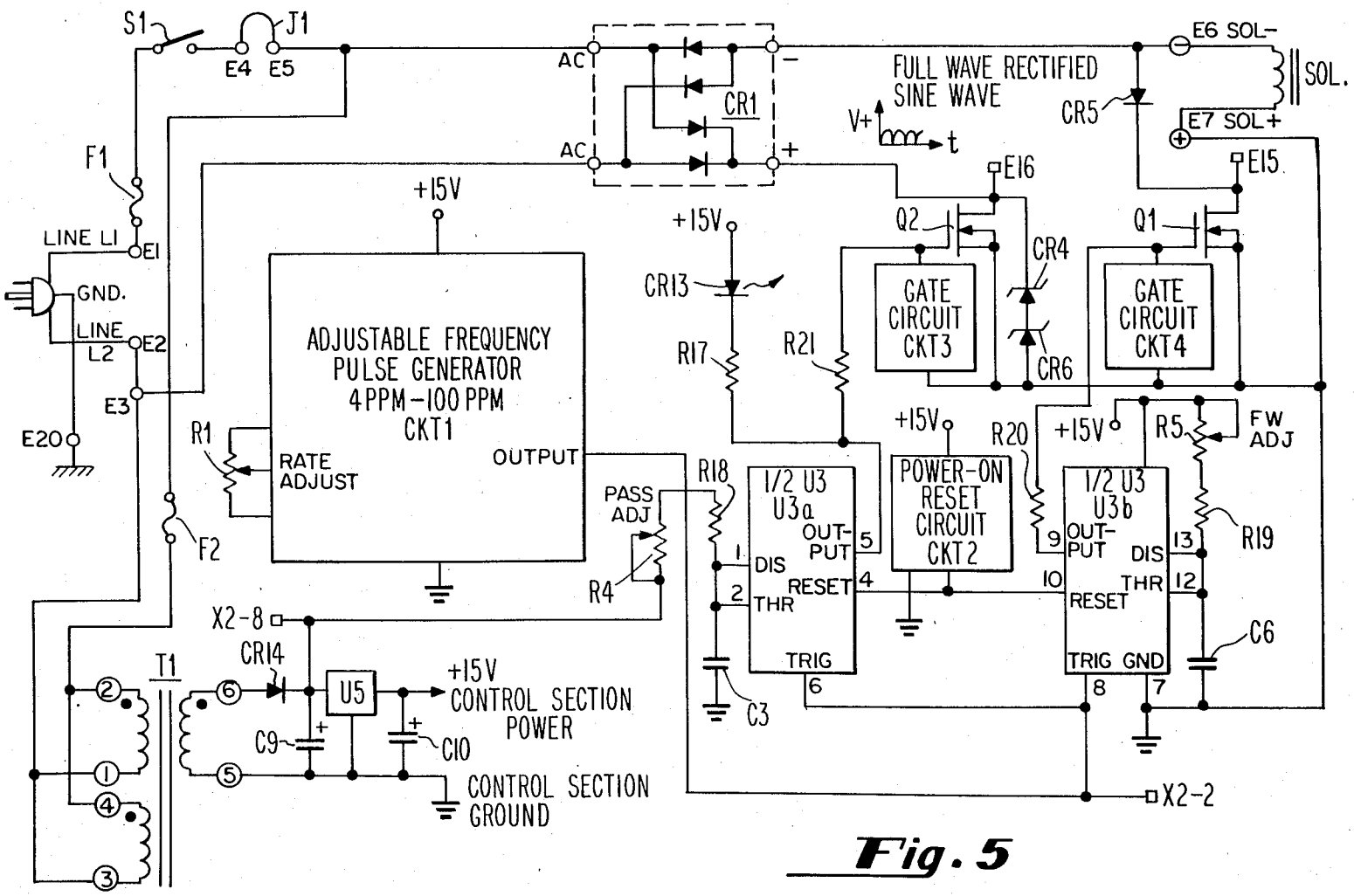
FIG. 5 is a circuit diagram, portions in block, illustrating the present supply voltage compensation system for maintaining substantially constant maximum operating pressure of a metering pump notwithstanding varying supply voltages.

Reference is now made to FIG. 5 of the drawings for a detailed description of the supply voltage compensation system of the present invention. FIG. 5 circuitry is described hereinafter with respect to its operation with alternating current supply voltages. It is understood however that the present circuit may also be used advantageously with direct current supply voltages. In such a case, logic power will be derived from the dc supply voltage through a voltage regulating circuit, and the need for transformer T1 will be obviated.

Portions of the circuitry of FIG. 5 are shown as functional blocks only; one skilled in the art of electronic circuit design will appreciate that these blocks may comprise any of a number of known components.

Referring now to FIG. 5, lines L1 and L2 are connected to terminals E1 and E2 respectively while chassis ground connects to terminal E20. Line L1 is routed through protective fuse F1, on/off switch S1 and jumper J1 from terminal E4 to E5. From terminal E5, the voltage is connected to each of two points, i.e., to one side of a full-wave rectifier CR1; and through protective fuse F2 to the primary of transformer T1, through the primary of transformer T1, and back to line L2 at terminal E2 through terminal E3. Line L2 also connects to the other side of full-wave rectifier CR1 via terminal E3. Assuming that both protective fuses F1 and F2 are in their normal (unblown) states, turning on switch S1 connects the ac line across the primary of transformer T1 as well as the inputs of full-wave rectifier CR1.

Transformer T1 supplies power to the control logic through rectifier CR14 and voltage regulator U5 with voltage-smoothing capacitors C9 and C10 on the input and output respectively of voltage regulator U5. Rectifier CR14 is configured as a half-wave rectifier supplying current to capacitor C9 on every alternate half-cycle of the 60 Hz ac line. Capacitor C9 smoothes these current pulses to produce a predominantly dc voltage at terminal X2-8. The average value of the voltage at terminal X2-8 is proportional to the amplitude of the ac line voltage. (The ac line has a normal variation in voltage of +/−10% of nominal). The voltage at terminal X2-8 is regulated down to 15 V by voltage regulator U5. The 15 V supply line provides power to the control logic or control section as shown. Capacitor C10 is a bypass capacitor used to suppress variations on the 15 V supply to the control logic.

Full-wave rectifier CR1 rectifies the voltage sine wave from the ac line. The positive full-wave rectifier bridge output is connected to terminal E16, the negative output being connected to terminal E6 of the solenoid. During operation, the voltage at terminal E16 with respect to the voltage at terminal E6 is a full-wave rectified sine wave, as shown in the inset.

The full-wave rectifier bridge positive output at E16 is connected to a solid-state switch Q2 and zener diodes CR4 and CR6. Solid-state switch Q2 may be a bipolar transistor, field-effect transitor, thyristor, or other suitable solid-state switching element or elements. The switch shown is a field-effect transistor. Zener diodes CR4 and CR6 clamp the voltage across Q2 to a voltage equal to the sum of the zener voltages of CR4 and CR6.

When solid-state switch Q2 is made to conduct, the positive output of full-wave rectifier CR1 is connected by switch Q2 to terminal E7, the positive terminal of the solenoid resulting in the solenoid being energized by current passing from the positive output of full-wave rectifier CR1 through switch Q2, through the solenoid winding, and back to the negative output of full-wave rectifier CR1.

Solid-state switch Q1 is connected between solenoid terminals E6 and E7 through rectifier CR5. When solid-state switch Q1 is made to conduct, and when terminal E6 is at a more positive voltage than terminal E7, current passes from terminal E6 through rectifier CR5 and through switch Q1 to terminal E7. When terminal E7 is more positive in voltage than terminal E6, rectifier CR5 is reverse-biased and passes no current. It is noted that terminal E7 will be more positive in voltage than terminal E6 whenever solid-state terminal switch Q2 is made to conduct. Terminal E6 will be more positive in voltage than terminal E7 for a period of time after the interruption of current through solid-state switch Q2 and through the solenoid. After the interruption of current through switch Q2 and the solenoid, the voltage at terminal E6 with respect to terminal E7 will rise to a sufficient voltage to cause an exponential decay in solenoid current, limited only by the clamping by zener diodes CR4 and CR6 through the full-wave rectifier bridge CR1 (if solid-state switch Q1 is not conducting), or limited by the forward voltage drop across the series connected rectifier CR5 and switch Q1 (if switch Q1 is conducting). In either case the solenoid current will decay to zero, but the decay time constant for the case where switch Q1 is conducting will be substantially longer than when switch Q1 is not conducting. Switch Q1 can also be turned on or off during the solenoid current decay time, with the decay time constant at any point determined by the state of switch Q1.

In FIG. 5, the solenoid is initially energized by turning on both switches Q1 and Q2. With switch Q2 conducting, the voltage at terminal E7 is positive with respect to the voltage at terminal E6, hence diode CR5 is reverse-biased and passes no current. Since current passes through the solenoid, this period is called the "pass" period. With switch Q1 held on and switch Q2 turned off, solenoid current passes through diode or rectifier CR5 and switch Q1 resulting in a slow decay of the solenoid current, called the "free-wheel" period (FIG. 1). Switch Q1 is then turned off such that solenoid current passes through full-wave rectifier CR1 and zener diodes CR4 and CR6 until the solenoid current has decayed to zero. The decay of solenoid current is very rapid (time constant on the order of 1 to 10 ms) once switch Q1 is turned off.

Both solid-state switches Q1 and Q2 are driven by integrated circuit timer U3 through resistors R20 and R21 respectively, with gate biasing and protection circuits CKT4 and CKT3 respectively as shown. Gate circuits CKT3 and CKT4 contain resistive, capacitive, and semiconductor elements which bias the solid-state switches and protect them against overvoltages. The exact form of gate circuits CKT3 and CKT4 depends upon the selection of solid-state device used as the switches.

An adjustable frequency pulse generator (designated CKT1) triggers both timer sections, i.e., U3a and U3b of integrated circuit timer U3, each section illustrated as ½ U3, at a rate set by a front-panel control potentiometer, shown as an input to the pulse generator, as are power supply (+15 V) and ground. The rate, as aforementioned, is adjustable over the range of 4 to 100 solenoid strokes per minute. Details of adjustable frequency pulse generator CKT1 are not shown since several implementations thereof are possible and obvious to one skilled in the art of electronic circuit design.

The output from the adjustable frequency pulse generator (CKT1) triggers both halves, i.e., U3a and U3b of integrated circuit timer U3 at terminal X2-2. Timer U3a controls the solid-state "pass" switch Q2 while timer U3b controls the solid-state free-wheel switch Q1. When the trigger pulse into pin 6 of timer U3a and pin 8 of timer U3b goes low, both outputs, i.e., pin 5 of timer U3a and pin 9 of timer U3b go high, thus turning on both solid-state switches Q1 and Q2. This trigger pulse also causes transistor switches internal to timer U3 to turn off. These transistor switches clamp the voltages at timer U3 pins 1 and 13 to nearly zero volts. When these transistor switches are turned off, capacitors C3 and C6 begin charging. Capacitor C3 charges from the voltage at terminal X2-8 through resistors R4 and R18. Capacitor C6 charges through resistors R5 and R19. Capacitor C3 charges towards a final voltage value equal to the voltage at terminal X2-8. Capacitor C6 charges towards a final value of 15 V (equal to the supply voltage). The output at pin 5 of timer U3a is high (approximately 15 V) while capacitor C3 is charging, and remains high until the capacitor voltage, as measured at pin 2 of timer U3a, exceeds two-thirds of the supply voltage, or 10 V. At this point, the output at pin 5 of timer U3a goes low, and the capacitor C3 is grounded through a transistor at pin 1 of timer U3a. This section of timer U3a remains in this state (output low, capacitor C3 clamped to ground) until a new trigger pulse retriggers this section. Meanwhile, following the application of the trigger pulse to pin 8 of timer U3b, capacitor C6 charges towards 15 V, and the output at pin 9 of timer U3b goes high. Capacitor C6 continues to charge until capacitor C6 voltage as measured at pin 12 of timer U3b exceeds two-thirds of the supply voltage, or 10 V. At this point, the output of pin 9 of timer U3B returns low, and capacitor C6 is grounded through a transistor internal to pin 13 of timer U3b. This section of U3b remains in this state (output low, capacitor C6 clamped to ground) until a new trigger pulse retriggers this section.

It should be noted that the time period within which timer U3b has a high output at pin 9 is equivalent to the time period required for capacitor C6 to charge to 10 V when charged by 15 V through resistors R5 and R19. This time period is fixed. Regarding timer U3a, the time period within which this integrated circuit timer half has a high output at pin 5 is equivalent to the time period required for capacitor C3 to charge to 10 V when charged by the voltage at terminal X2-8 through resistors R4 and R18. This time period is not fixed, but varies with the ac line voltage. The voltage at terminal X2-8 is directly proportional to the ac line voltage. As the ac line voltage increases, the time required for capacitor C3 to charge to 10 V decreases. Conversely, as the ac line voltage decreases, the time required for capacitor C3 to charge to 10 V increases. Thus, the full-wave rectified line voltage is applied across the solenoid for a shorter time when the ac line voltage is higher than normal, and for a longer time when the ac line voltage is lower than normal, thus compensating for the changes in solenoid current which would occur with a varying ac line voltage. Therefore, the present circuit compensates for changes in ac line voltage and holds the peak solenoid current relatively constant even as the ac line voltage varies. The present invention may also be used with direct current supply voltages as previously mentioned with the limitations hereinbefore noted.

Variable resistors R4 and R5 provide means for adjusting the pass period and freewheel period respectively. Component CR13 is a light-emitting diode which flashes for each solenoid stroke, i.e., when the output at pin 5 of half timer U3a is low. Resistor R17 is interposed between pin 5 and diode CR13.

Each section of integrated circuit timer U3 is reset, i.e., both half timers U3a and U3b, when the metering pump is turned on with switch S1 by means of a power-on reset circuit designated in block form as CKT2. Circuit CKT2 contains resistive, capacitive, and semiconductor elements which provide a logic-low voltage to pin 4 of timer U3a and pin 10 of timer U3b for a period of time on the order of about 1 to 100 ms after the 15 V power supply voltage is established. Details of circuit CKT2 are not shown since several implementations thereof are possible and within the province of a skilled artisan.

Figure 6:
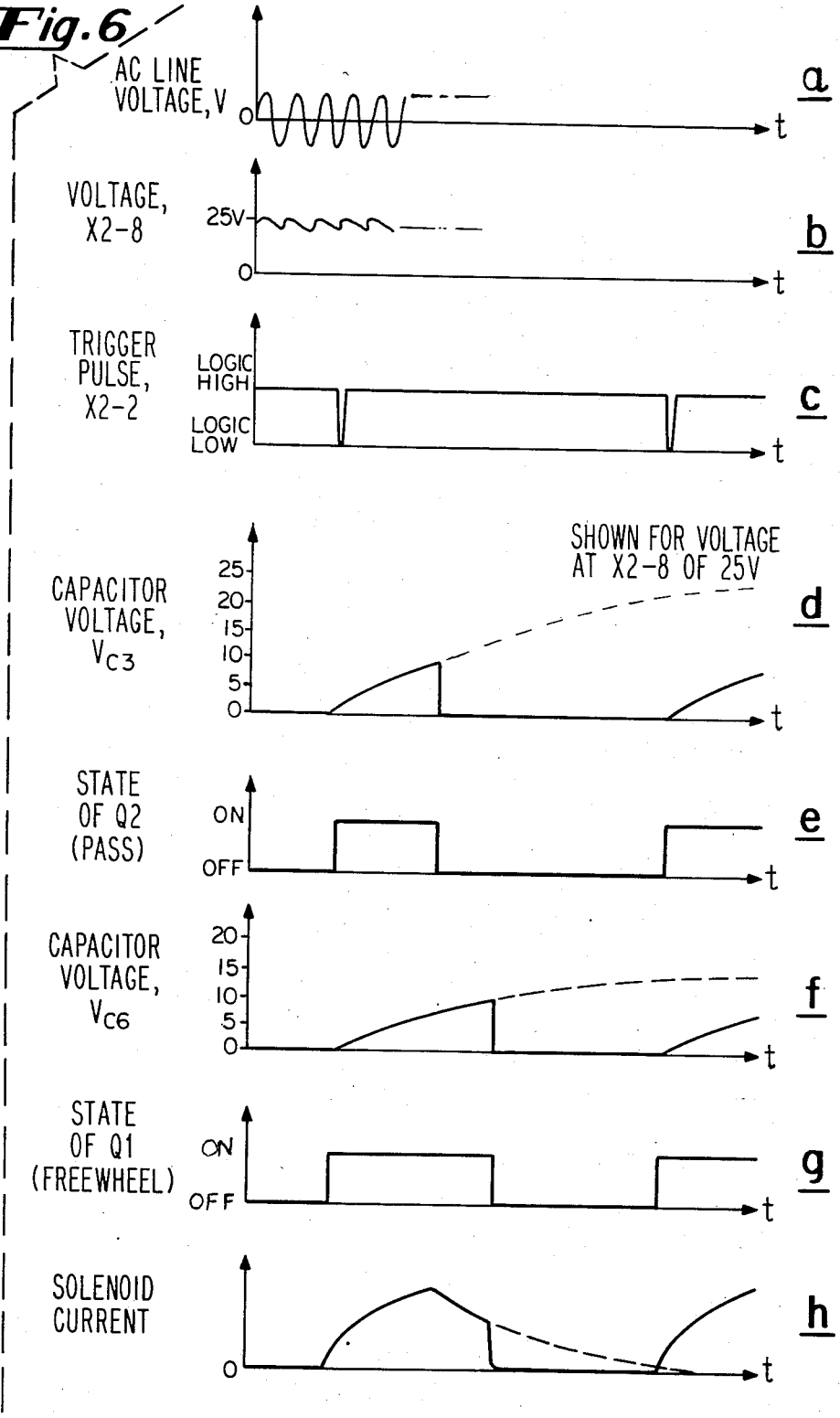
FIG. 6 illustrates waveforms of solenoid current generated over a single solenoid stroke.

In further clarification of the invention, reference is made to FIG. 6 of the drawings, which illustrates in a series of graphs the operation of the circuit over a single solenoid stroke. Each of the graphs, i.e., FIGS. 6*a* through 6*h*, depicts operation of a portion of the circuit and are each drawn to the same time scale.

FIG. 6*a* illustrates ac sinusoidal line voltage typically at 60 Hz. The ac line voltage is stepped down by transformer T1, then rectified by rectifier CR14. The rectified voltage is filtered by capacitor C9 to produce a dc voltage with some ripple as shown in FIG. 6*b*. The average value of the voltage at terminal X2-8 is directly proportional to the ac line voltage. In FIG. 6*b* the average voltage at X2-8 is shown as 25 V.

A solenoid stroke is initiated by a negative-going trigger pulse as shown in FIG. 6*c*, generated by adjustable frequency pulse generator CKT1. The trigger pulse is applied to both halves of integrated circuit timer U3, i.e., U3a and U3b. At the negative edge of the trigger pulse, both solid-state switches Q1 and Q2 turn on, as shown respectively in FIGS. 6*g* and 6*e*; capacitors C3 and C6 also are released to begin charging. Capacitor C3 is charged from the voltage at terminal X2-8 through resistors R4 and R18. Charging of capacitor C3 is shown in FIG. 6*d* where voltage at terminal X2-8 is 25V. When the voltage on capacitor C3 reaches 10 V, capacitor C3 reaches 10 V, capacitor C3 is grounded by a transistor internal to the integrated circuit timer, and switch Q2 is turned off. The trigger pulse also causes the integrated circuit timer U3 to release capacitor C6 to begin charging. When the voltage on capacitor C6 reaches 10 V (FIG. 6*f*), capacitor C6 is grounded by a transistor internal to the integrated timer U3 and switch Q1 is turned off.

Solenoid current is shown in FIG. 6*h;* its curve has been discussed above with reference to "pass" and "freewheel" periods.

Figure 7:
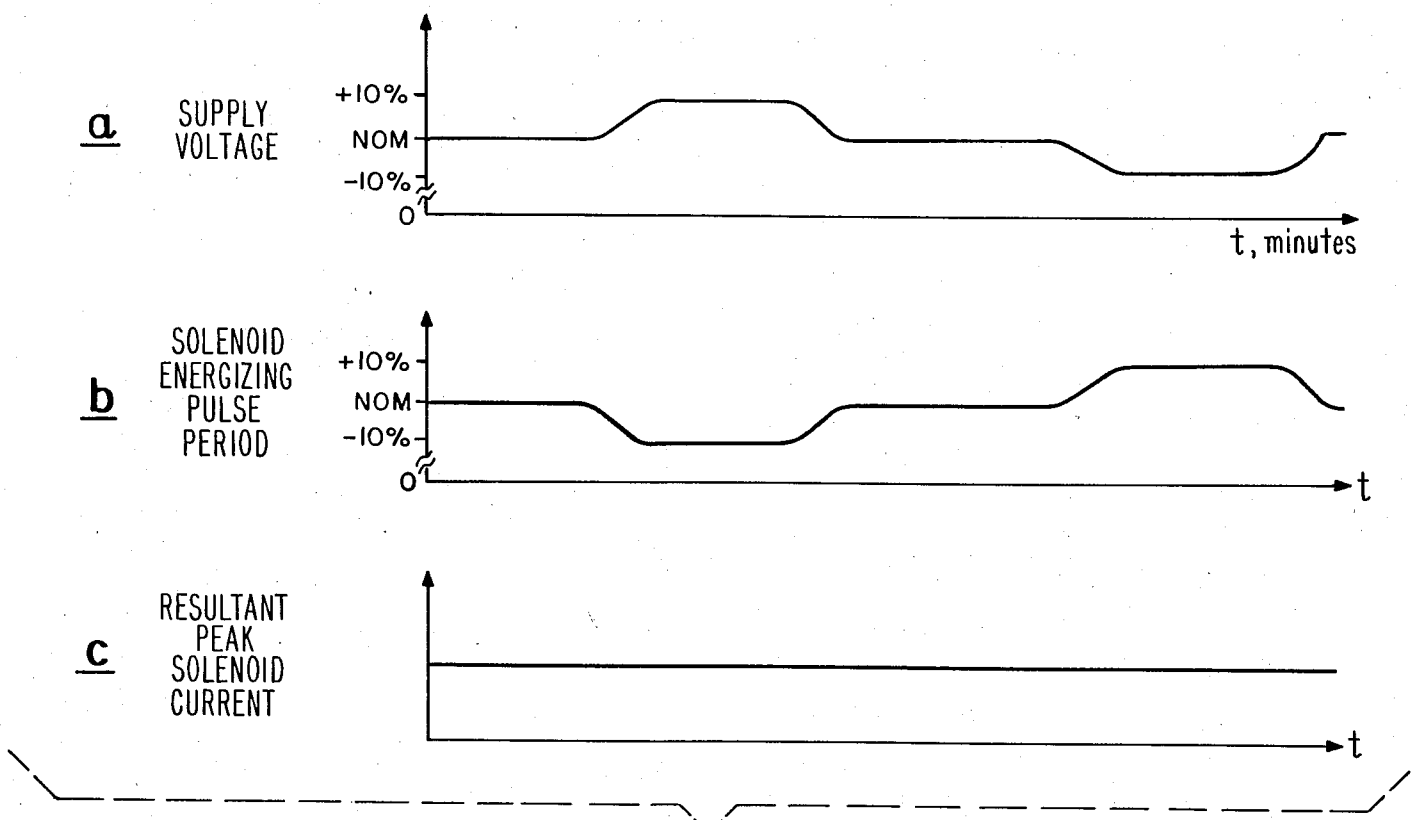
FIG. 7 illustrates the substantially inverse relationship between varying supply voltage and solenoid on-time over a long time interval and the resultant peak solenoid current.

In FIG. 7, operation of the circuit over a large scale time frame, in minutes, for example, is shown. Each of the graphs, i.e., FIGS. 7*a* through 7*c*, depicts operation over the identical time interval.

In FIG. 7*a*, the waveform for supply voltage is shown varying from nominal to 10% higher than nominal, back to nominal, and then to 10% lower than nominal.

By virtue of portions of the circuit abovedescribed including threshold circuit capacitor C3 being charged from the voltage at terminal X2-8 after being rectified and filtered, the energizing pulse period for the solenoid varies from nominal to about 10% lower than nominal, back to nominal and about 10% higher than nominal, as illustrated in FIG. 7*b*, or substantially inversely proportional to the supply voltage (FIG. 7*a*).

The resultant peak solenoid current is constant as shown (FIG. 7*c*) after the normal variations in the supply voltage have been anticipated and compensated for by the circuitry of the present invention.

I claim:

1. A compensation circuit for solenoid driven apparatus for supplying voltage to said solenoid, said voltage varying within normal operating range from nominal, said circuit comprising means for applying said voltage to said solenoid for an on-time energizing pulse period wherein duration of said period is in substantial inverse relationship to said normal operating range variations from nominal of said supply voltage.

2. Circuit of claim 1 wherein said on-time energizing pulse period is controlled by an integrated circuit timer having a charging network associated therewith, said network being energized by a voltage proportional to said supply voltage.

3. Circuit of claim 1 wherein said on-time energizing pulse period voltage delivered by said compensation circuit to said solenoid provides a substantially constant peak solenoid current.

4. Circuit of claim 1 wherein said solenoid driven apparatus is a metering pump.

5. Circuit of claim 3 wherein said substantially constant peak solenoid current provides substantially constant maximum force to each stroke of said solenoid.

6. Circuit of claim 5 wherein said substantially constant force of each stroke of said solenoid is applied to piston of a metering pump.

7. A compensation circuit for solenoid driven apparatus for supplying voltage to said solenoid, said voltage being an ac line voltage varying within a normal range of about + or −10% from a nominal voltage, said circuit comprising means for applying said line voltage to said solenoid for an on-time energizing pulse period wherein duration of said period is longer when said line voltage falls below said nominal voltage and shorter when said line voltage rises thereabove.

8. Circuit of claim 7 wherein said period durations and ac line voltage variations are in substantial inverse relationship.

9. Circuit of claim 8 wherein said inverse relationship exists over entire range of said normal ac line variations.

10. Circuit of claim 7 wherein a waveform of said ac line voltage variations above, at, and below nominal projected over a time interval of minutes is a substantial mirror image of waveform of said on-time energizing pulse period voltage applied to said solenoid over said time interval in minutes.

11. Circuit of claim 7 wherein said apparatus is a metering pump.

12. Circuit of claim 11 wherein a substantially constant peak solenoid current results when said on-time energizing pulse period voltage is applied to said solenoid to thereby prevent said metering pump from stalling and permitting said pump to run cooler when said line voltage rises above nominal operating voltage.

* * * * *